US007873177B2

(12) United States Patent
Okamura et al.

(10) Patent No.: US 7,873,177 B2
(45) Date of Patent: Jan. 18, 2011

(54) HEADPHONE APPARATUS AND HEADPHONE SYSTEM

(75) Inventors: Toru Okamura, Saitama (JP); Naoki Watanabe, Saitama (JP); Naotaka Tsunoda, Tokyo (JP)

(73) Assignee: Sony Corporation, Tokyo (JP)

( * ) Notice: Subject to any disclaimer, the term of this patent is extended or adjusted under 35 U.S.C. 154(b) by 1332 days.

(21) Appl. No.: 11/389,377

(22) Filed: Mar. 27, 2006

(65) Prior Publication Data

US 2006/0215868 A1 Sep. 28, 2006

(30) Foreign Application Priority Data

Mar. 28, 2005 (JP) ..... 2005-091862

(51) Int. Cl.
*H04R 25/00* (2006.01)

(52) U.S. Cl. ..... 381/374; 381/384

(58) Field of Classification Search ..... 381/370, 381/374, 375, 380, 384, 385; 379/428.02, 379/428.08; 320/114, 115; 455/575.2, 572, 455/573, 569.1, 569.2

See application file for complete search history.

(56) References Cited

U.S. PATENT DOCUMENTS

| | | | | |
|---|---|---|---|---|
| 5,095,382 | A * | 3/1992 | Abe | 381/384 |
| 6,735,306 | B1 | 5/2004 | Heinz | |
| 6,772,853 | B2 * | 8/2004 | Yang | 381/370 |
| 2003/0169898 | A1 * | 9/2003 | Arasawa | 381/370 |
| 2004/0131220 | A1 * | 7/2004 | Liu | 381/375 |

FOREIGN PATENT DOCUMENTS

| | | |
|---|---|---|
| JP | 7-327291 | 12/1995 |
| JP | 2002-522993 | 7/2002 |
| JP | 2004-112858 | 4/2004 |

* cited by examiner

*Primary Examiner*—Brian Ensey
(74) *Attorney, Agent, or Firm*—Oblon, Spivak, McClelland, Maier & Neustadt, L.L.P.

(57) ABSTRACT

An ear-hanger headphone apparatus includes ear hangers each having a predetermined shape, housings integrally attached to the ear hangers, respectively, and driver units attached to the housings swingably relative thereto so as to closely overlap with ear conches without clearance, respectively, when the headphone apparatus is worn.

10 Claims, 9 Drawing Sheets

HEADPHONE APPARATUS AND HEADPHONE SYSTEM

CROSS REFERENCES TO RELATED APPLICATIONS

The present invention contains subject matter related to Japanese Patent Application JP 2005-091862 filed in the Japanese Patent Office on Mar. 28, 2005, the entire contents of which are incorporated herein by reference.

BACKGROUND OF THE INVENTION

1. Field of the Invention

The present invention relates to a headphone apparatus and a headphone system being suitable for incorporating an ear-hanger headphone.

2. Description of the Related Art

Some headphone apparatuses have been worn by hooking predetermined-shaped wearing retainers provided as part of a head band on ear conches in a state that driver units provided on both sides of the flexible head band are pressed on user's ears (see Japanese Unexamined Patent Application Publication No. 10-257581).

SUMMARY OF THE INVENTION

In the headphone apparatus with such a structure, since the pushed angle of the driver unit to the ear is fixed at the manufactured state, the driver unit may not sufficiently correspond to the individual difference of each user in ear shape and ear opening, so that optimum wearing cohesive feeling without clearance may not necessarily be provided to all users.

The present invention has been made in view of situations described above, and it is desirable to propose a headphone apparatus and a headphone system by making further progress in wearing feeling so as to improve the sound quality.

In order to solve such problems, an ear-hanger headphone apparatus includes a chin band having a roughly U-shaped and flexible band part positioned below a chin when wearing the headphone apparatus; housings attached to ends of the band part, respectively; driver units attached to the housings swingably relative thereto so as to closely overlap with ear conches without clearance when the driver units are pushed to the ear conches by the flexibility of the band part, respectively; and ear hangers, each having a predetermined shape, provided to the ends of the band part, respectively.

By this structure, when the headphone apparatus is worn via the ear hangers and the driver units are urged to ear conches due to the flexibility of the band part, respectively, the driver units are swingable in accordance with shapes of the ear conches, so that the headphone apparatus can be worn in a closely overlapped state without clearance despite of the shapes of the ear conches so as to provide high-quality sounds to users.

An ear-hanger headphone apparatus according to an embodiment of the present invention includes ear hangers each having a predetermined shape; housings integrally attached to the ear hangers, respectively; and driver units respectively attached to the housings swingably relative thereto so as to closely overlap with ear conches without clearance when the headphone apparatus is worn.

By this structure, when the headphone apparatus is worn via the ear hangers and the driver units are urged to ear conches due to the flexibility of the band part, respectively, the driver units are swingable in accordance with shapes of the ear conches, so that the headphone apparatus can be worn in a closely overlapped state without clearance despite of the shapes of the ear conches so as to provide high-quality sounds to users.

Furthermore, a headphone system according to another embodiment of the present invention includes an ear-hanger headphone apparatus including a chin band having a roughly U-shaped and flexible band part positioned below a chin when wearing the headphone apparatus; housings attached to ends of the band part, respectively, driver units attached to the housings swingably relative thereto so as to closely overlap with ear conches without clearance when the driver units are pushed to the ear conches by the flexibility of the band part, respectively, and ear hangers, each having a predetermined shape, provided to the ends of the band part, respectively; and a relay transmitter for transmitting data by means of radio communications with the ear-hanger headphone apparatus.

By this structure, when the headphone apparatus is worn via the ear hangers and the driver units are urged to ear conches due to the flexibility of the band part, respectively, the driver units are swingable in accordance with shapes of the ear conches, so that the headphone apparatus can be worn in a closely overlapped state without clearance despite of the shapes of the ear conches so as to provide high-quality sounds on the basis of data transmitted from the relay transmitter by means of radio communication.

According to the present invention, when the headphone apparatus is worn via the ear hangers and the driver units are urged to ear conches due to the flexibility of the band part, respectively, the driver units are swingable in accordance with shapes of the ear conches, so that the headphone apparatus can be worn in a closely overlapped state without clearance despite of the shapes of the ear conches, thereby achieving a headphone apparatus and a headphone system capable of providing high-quality sounds to users and further improving wearing feeling compared with the past.

DESCRIPTION OF THE PREFERRED EMBODIMENTS

Embodiments of the present invention will be described in detail with reference with the drawings.

Figure 1:
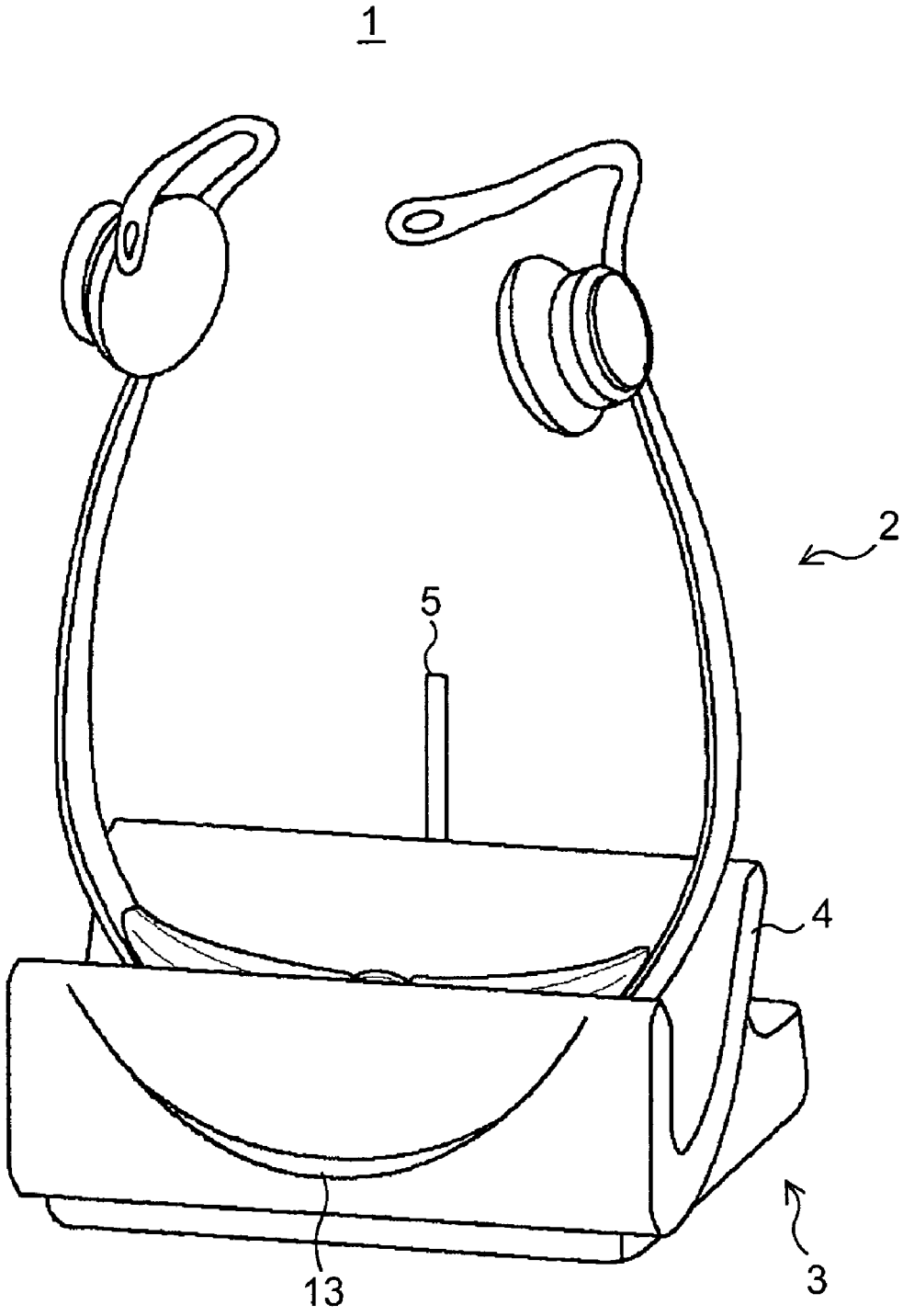
FIG. 1 is a schematic perspective overview of a wireless headphone system.

(1) Structure of Wireless Headphone System (1-1) Overview of Wireless Headphone System Referring to FIG. 1, a wireless headphone system 1 according to the present invention includes an ear-hanger headphone apparatus 2 and a transmitter 3 for transmitting data to the headphone apparatus 2 by means of radio communications.

In the wireless headphone system 1, when the headphone apparatus 2 is inserted into a rack 4 of the transmitter 3, the headphone apparatus 2 can be electrically charged by the transmitter 3. At this time, the turning on of an indicator lamp 13 of the rack 4 indicates that the headphone apparatus 2 is being charged while the turning off of the indicator lamp 13 indicates the finished charge for visual observation by a user.

On the other hand, in the wireless headphone system 1, when the headphone apparatus 2 is removed from the rack 4, the transmitter 3 can transmit data to the headphone apparatus 2 via an antenna 5 attached on the back side of the rack 4 by means of radio communications.

(1-2) Structure of Transmitter

Figure 2:
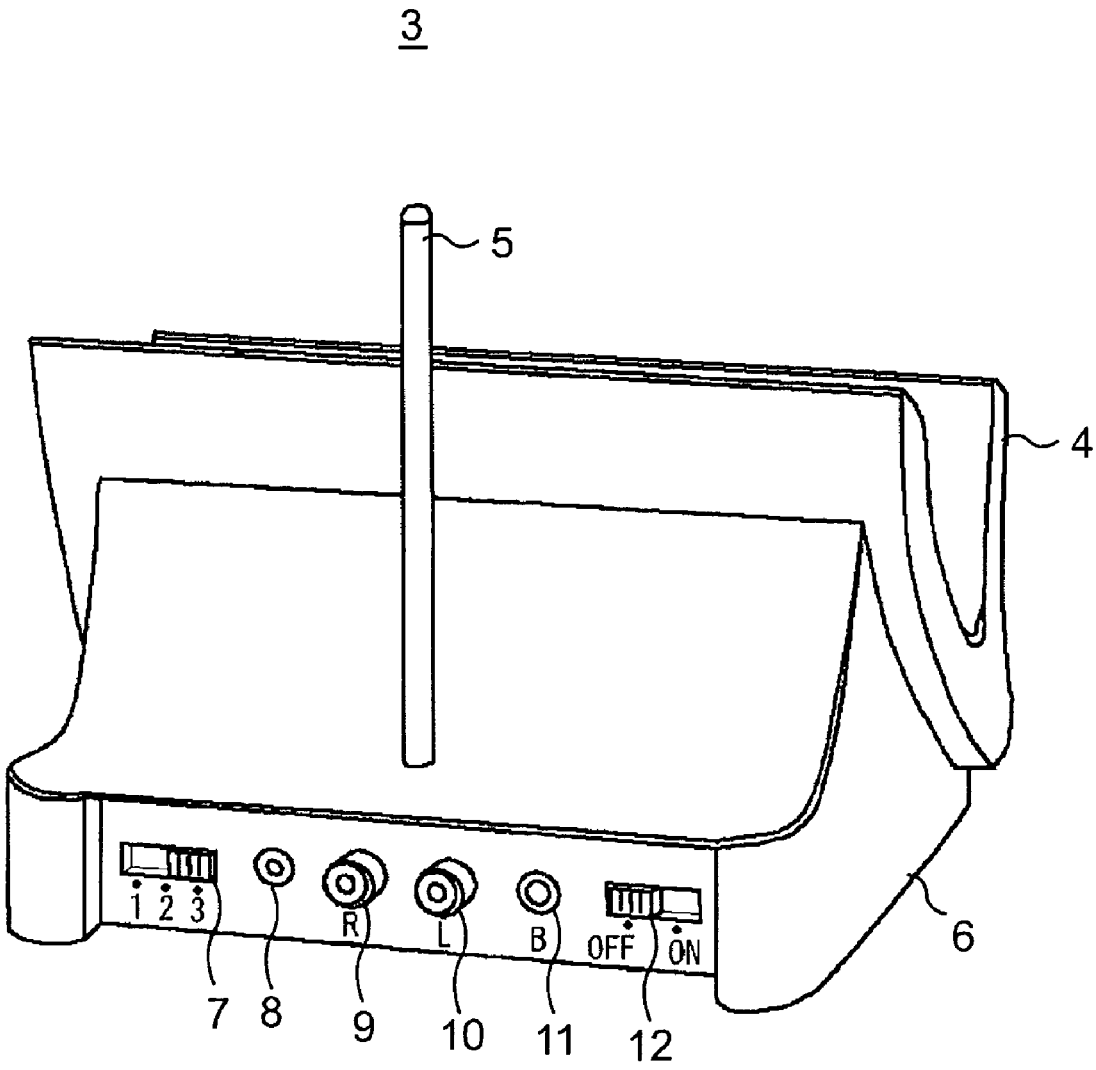
FIG. 2 is a schematic perspective view showing the rear side of a transmitter.

As shown in FIG. 2, in the transmitter 3, the rack 4 is stably supported by a body base 6 formed integrally with the rack 4, and on the rear face of the body base 6, a three-channel radio channel switch 7, a DC-supply jack 8, pin jacks 9 and 10, a stereo mini-jack 11, a noise filter on/off switch 12 are provided. On the bottom of a portion of the rack 4 for inserting the headphone apparatus 2, a terminal is also provided for charging the headphone apparatus 2.

In particular, the radio channel switch 7 is used for switching a radio channel during radio communications between the transmitter 3 and the headphone apparatus 2; the pin jacks 9 and 10 and the stereo mini-jack 11 are used for inserting a connection plug for stereophonically inputting the reproducing output of a sound source such as a CD (compact disk) player; and the noise filter on/off switch 12 is used for switching whether noise is filtered or not.

(1-3) Structure of Headphone Apparatus

Figure 3:
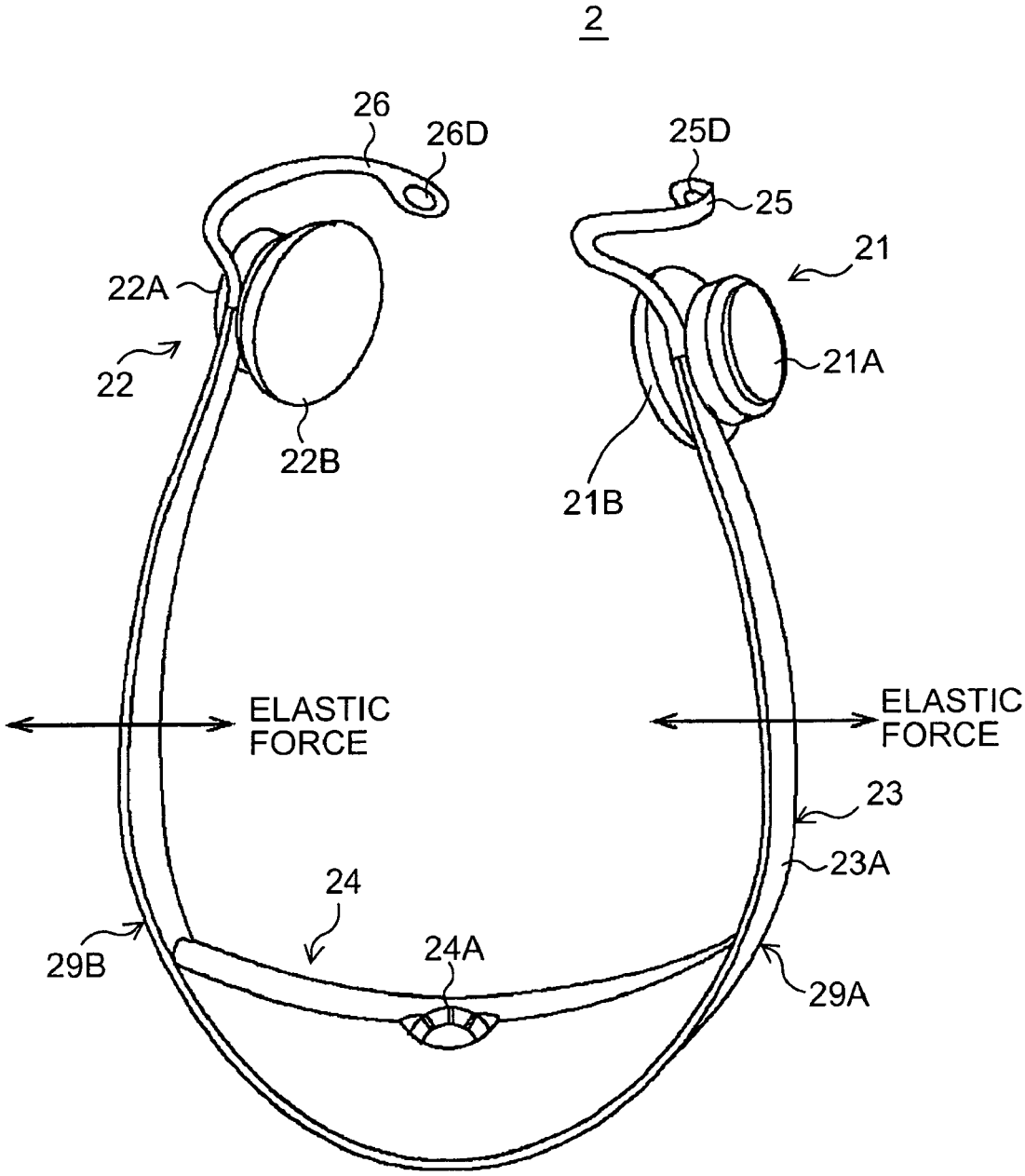
FIG. 3 is a front schematic perspective view of a headphone apparatus.
Figure 4:
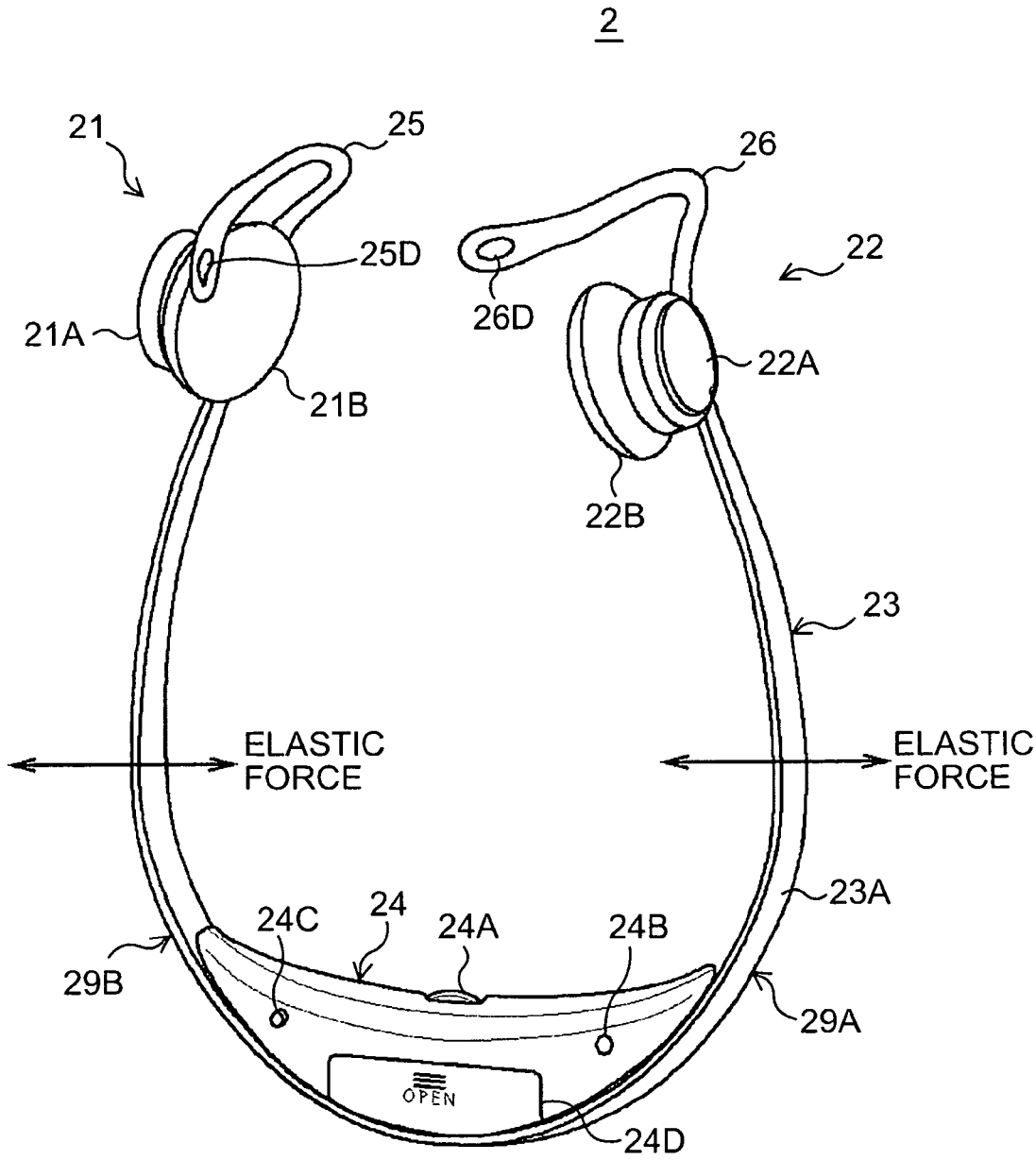
FIG. 4 is a schematic perspective view showing the wearing side of the headphone apparatus.

On the other hand, as shown in FIGS. 3 and 4, to the headphone apparatus 2, a polypropylene chin band 23 is attached at its ends, which are left and right ear applied parts 21 and 22, so as to have a U-shape wrapping a user's chin around thereunder when being worn on the user.

The chin band 23 is provided with a crescent radio communication unit 24 arranged about at the center of its band part 23A having comparatively heavy operation buttons for turning on/off the power supply and adjusting a variable resistor.

The radio communication unit 24 (FIG. 4) is provided with operation buttons such as a variable resistor adjusting rotary knob 24A arranged at about the central upper end, a power supply turning on/off button 24B arranged on the right side, and a three-channel radio channel switch button 24C similar to the transmitter 3, and further a battery storage 24D arranged between the power supply turning on/off button 24B and the radio channel switch button 24C for accommodating a secondary cell. On the bottom of the headphone apparatus 2, a terminal is provided for charging the secondary cell when the headphone apparatus 2 is inserted into the rack 4 of the transmitter 3 shown in FIG. 1 so as to connect the charging terminal of the rack 4 thereto.

Thereby, upon starting or completing the headphone apparatus 2, a user pushes down the power supply turning on/off button 24B; upon adjusting a sound volume, rotates the variable resistor adjusting rotary knob 24A on either side; and upon changing the radio channel, pushes down the radio channel switch button 24C.

Figure 10:
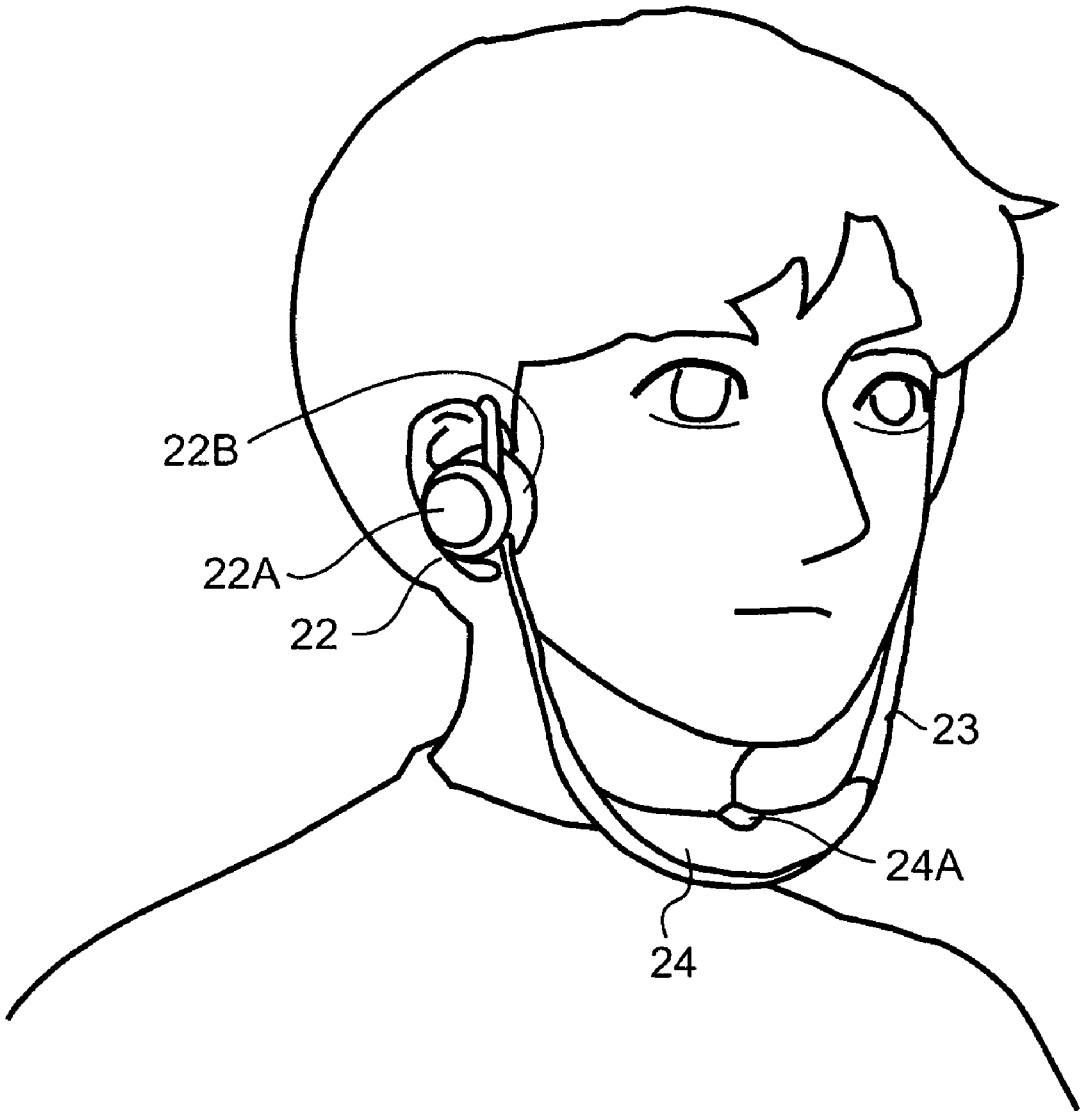
FIG. 10 is a front schematic perspective view showing a worn state of the headphone apparatus to a user.

In the chin band 23, the appropriately U-shaped band part 23A is flexible and elastically movable in arrow lateral directions, so that when the headphone apparatus 2 is worn, the left-ear applied part 21 and the right-ear applied part 22 are held in a state pushed to user's left and right ear conches by urging forces applied using boundary portions 29A and 29B between the band part 23A and the radio communication unit 24 as fulcrums, respectively. In addition, a worn state of the headphone apparatus 2 to a user is shown in FIG. 10.

The radio communication unit 24 includes various circuits arranged inside for demodulation processing data received from the transmitter 3 by means of radio communications, and their circuit configurations will be described later.

The left-ear applied part 21 and the right-ear applied part 22 include cylindrical housings 21A and 22A, respectively, to which respective both ends of the band part 23A of the chin band 23 are fixed, and further driver units 21B and 22B are attached, respectively.

Figure 5:
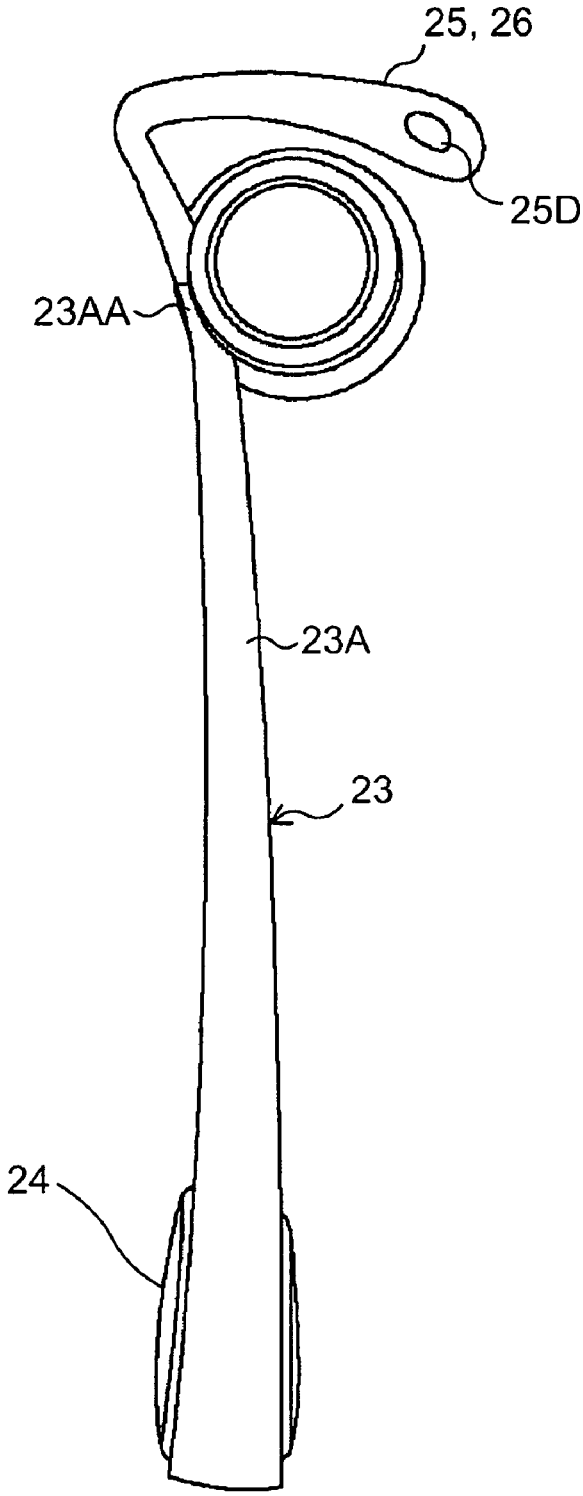
FIG. 5 is a schematic side view of the headphone apparatus.

In the left-ear applied part 21 and the right-ear applied part 22, as shown in FIG. 5, an appropriately L-shaped ear hanger 25 (26) made of an elastomer resin for wearing by hanging it on a user's ear conch is attached to the respective both ends 23AA of the band part 23A in the chin band 23, so that the ear hangers 25 and 26 achieve the same function as temples of eyeglasses.

The ear hangers 25 and 26 are made of an elastomer resin as mentioned above, so that while they provide soft wearing feeling to a user, the wearing state can be easily maintained due to the difficulty in slippage.

In the headphone apparatus 2, since the wearing state can be maintained using the non-slippery ear hangers 25 and 26 made of the elastomer resin in such a manner, it is difficult to give a user the heaviness feeling due to the chin band 23 during wearing the headphone apparatus 2, so that it may be worn for a long time.

The ear hangers 25 and 26 may also be made of soft plastics other than the elastomer resin.

Figure 6:
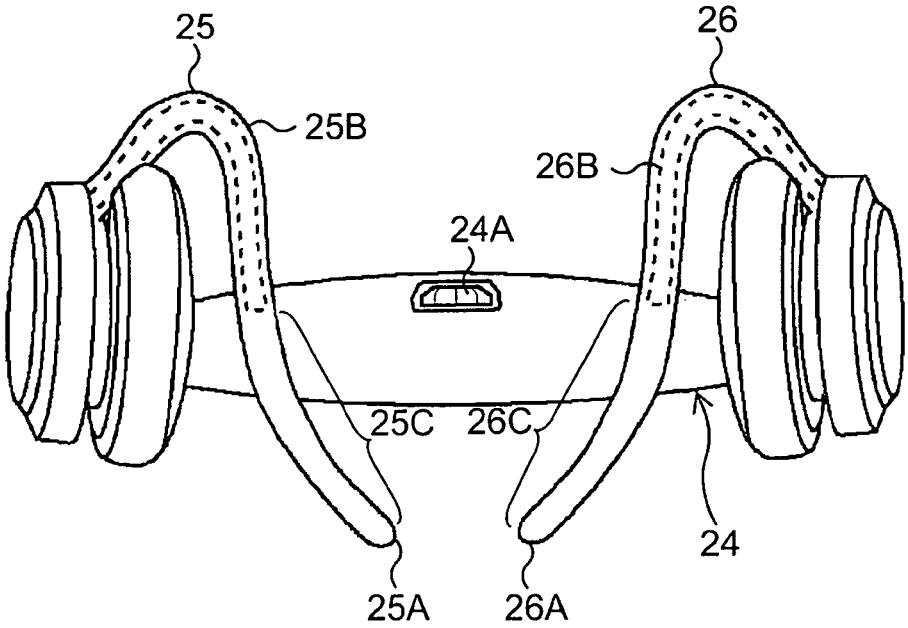
FIG. 6 is a schematic top view of the headphone apparatus.

As shown in FIG. 6, the ear hangers 25 and 26 have a shape gradually curved inside toward their respective ends 25A and 26A. When the ear hangers 25 and 26 are put on from the front of a user's head, they are pushed in a state that the ends 25A and 26A abut user's temples as they are, and finally, they are held in a state that the ear hanger 25 (26) intervenes between the back root of the ear conch and the head, and the ends abut the head.

Thereby, in the headphone apparatus 2, the ear hangers 25 and 26 are used in the same way as in the temples of eyeglasses, so that a user could put the headphone without uncomfortable feeling as if he or she were wearing eyeglasses.

The ear hangers 25 and 26 are attached by covering metallic wire frames 25B and 26B extended from the both ends 23AA (FIG. 5) of the band part 23A in the chin band 23, respectively. At this time, lengths of the frames 25B and 26B are limited to a predetermined length so as not to reach the ends 25A and 26A of the ear hangers 25 and 26, respectively.

End portions 25C and 26C of the ear hangers 25 and 26 where the frames 25B and 26B do not exist are thereby flexible, further improving wearing comfort when the ear hangers 25 and 26 are worn on a user's head.

The ear hangers 25 and 26 are provided with through-holes 25D and 26D formed in end portions with a predetermined shape, respectively (FIGS. 3 and 4), so as to have a feature in design as well as to prevent the end portions 25C and 26C from being too cured in comparison with an otherwise case, further improving wearing comfort when the ear hangers 25 and 26 are worn on a user's head.

Then, structures of the left-ear applied part 21 and the right-ear applied part 22 will be described. Since both the parts have the same structure, only the left-ear applied part 21 is described herein and the other is omitted for convenience sake.

Figure 7:
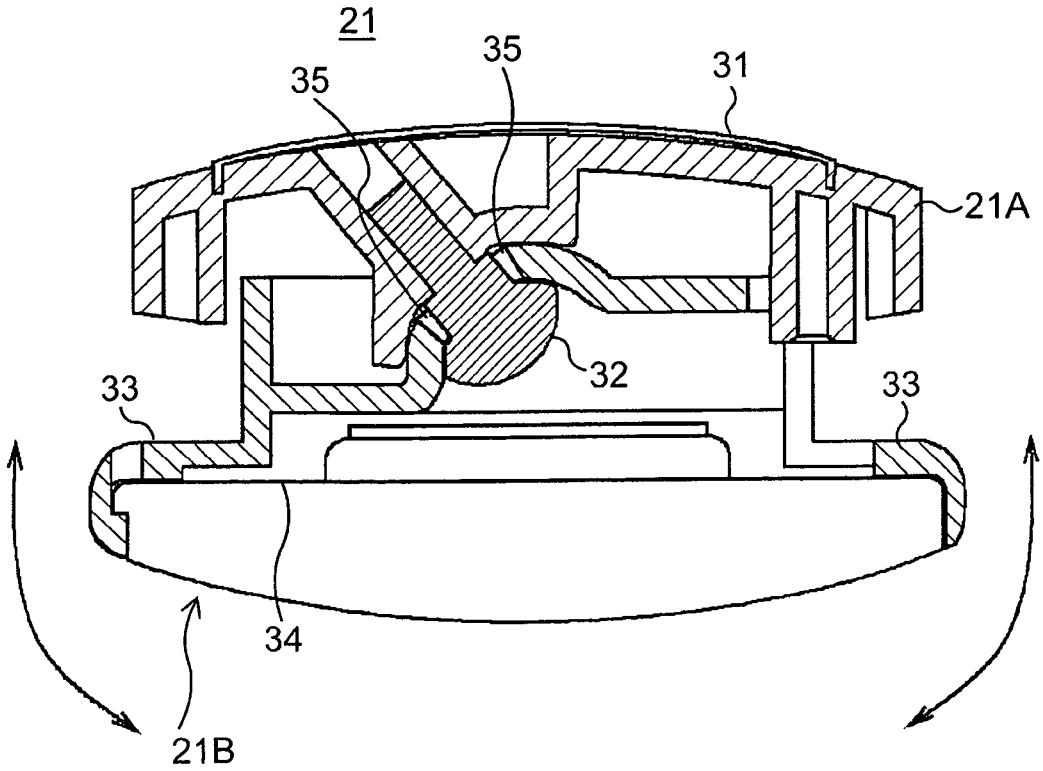
FIG. 7 is a sectional view for illustrating the structure of a left-ear applied part.

As shown in FIG. 7, the left-ear applied part 21 includes a cylindrical housing 21A having a cap 31 attached on the surface and a screw 32 which is screwed into the housing 21A in an oblique direction with a driver unit 21B therebetween so as to attach the driver unit 21B to the housing 21A swingably in universal directions.

That is, a front plate 33 of the driver unit 21B having a diaphragm 34 attached thereto is connected to the screw 32 with a clearance 35 therebetween, so that the driver unit 21B can swing about the screw 32 in the universal directions within a movable range corresponding to the clearance 35.

Since the driver units 21B and 22B of the left- and right-ear applied parts 21 and 22 can swing relative to the housings 21A and 22A, respectively, in such a manner, when the driver units 21B and 22B are pushed onto user's ear conches, the headphone apparatus 2 can be worn by fitting it to each user's ear conches in direction and shape so as to have no clearance therebetween.

In the left-ear applied part 21, the screw 32 is attached to the housing 21A in an oblique direction; alternatively, when thicknesses of the housing 21A and the driver unit 21B need not be reduced, the screw 32 may be fixed to the housing 21A in a direction perpendicular thereto.

In the driver units 21B and 22B, although not shown, a sponge ear pad is attached on the front plate 33, so that when wearing the headphone apparatus 2 in practice, the driver units 21B and 22B are not directly pushed to the head, but soft wearing feeling is given to a user through the ear pads.

(1-4) Circuit Configuration of Wireless Headphone System

Figure 8:
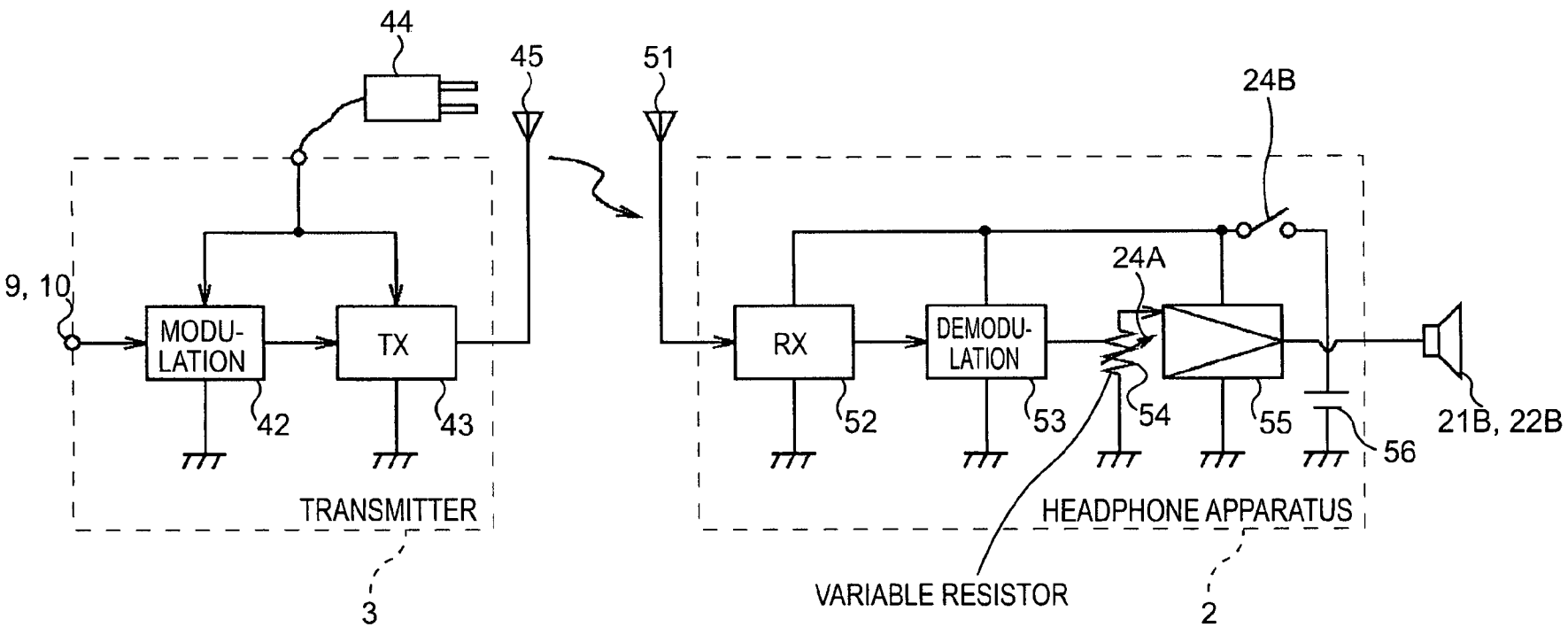
FIG. 8 is a schematic block diagram of the circuit of the wireless headphone system.

As shown in FIG. 8, in the transmitter 3 of the wireless headphone system 1, electric power is supplied from an AC adaptor 44 to a modulation circuit 42 and a transmitting circuit 43, and an audio signal supplied from a sound source is input in the modulation circuit 42 via the pin jacks 9 and 10 (FIG. 2).

The modulation circuit 42 modulates the audio signal by a predetermined modulation system so as to feed the resultant modulated signal to the transmitting circuit 43. The transmitting circuit 43 converts the modulated signal frequency into a predetermined transmit frequency as well as amplifies the modulated signal at a predetermined level so as to transmit the resultant transmit signal to the headphone apparatus 2 via an antenna 45 by means of radio communications.

According to the embodiment, between the transmitter 3 and the headphone apparatus 2, the communications are executed by a close range radio communication system such as IEEE (institute of electrical electronics engineers) 802.11g; alternatively, Bluetooth™ may be used as the close range radio communication system, and other various close range radio communication systems may also be used.

In the headphone apparatus 2, electric power is supplied from a DC power supply 56 to a receiving circuit 52, a demodulation circuit 53, and an amplifier 55 via a power supply turning on/off button 24B while a transmitting signal is received from the transmitter 3 via an antenna 51 so as to send it to the receiving circuit 52 as a received signal.

The antenna 51 may be provided in the radio communication unit 24; alternatively, it may not be especially provided for simplicity because a signal line for supplying an audio signal demodulated by a receiving circuit within the radio communication unit 24 inside the band part 23A of the chin band 23 in the headphone apparatus 2 is serving as an antenna.

The receiving circuit 52 supplies the received signal to the demodulation circuit 53 after frequency conversion processing, and the demodulation circuit 53 demodulates the signal by the modulation system corresponding to that in the modulation circuit 42 in the transmitter 3 so as to feed the resultant demodulated signal to the amplifier 55 via a variable resistor 54.

The amplifier 55 amplifies the demodulated signal at a predetermined level and then, outputs it to the driver units 21B and 22B. The variable resistor 54 can adjust the sound volume to be output from the driver units 21B and 22B using a volume adjustment knob 24A (FIG. 4).

(2) Operation and Effect

By the configuration described above, in the headphone apparatus 2, when the ear hangers 25 and 26 are mounted on user's conches, using the flexibility of the band part 23A of the chin band 23, the left-ear applied part 21 and the right-ear applied part 22 can be urged onto the user's conches from outside, respectively.

Since the driver units 21B and 22B are swingably attached to the housings 21A and 22A, respectively, the headphone apparatus 2 may be closely overlapped with user's ear conches in conformity with their direction and shape without clearance. Thereby, to the users, comfortable wearing feeling as well as high-quality sound may be provided.

Simultaneously, with the structure of the headphone apparatus 2 in that the band part 23A of the chin band 23 is positioned below a chin, the usability is further improved by solving problems, such as that the band part is positioned in a user's rear head so as to disarrange user's hear style and that senior users may find difficulty in wearing the headphone apparatus 2, as shown in Japanese Unexamined Patent Application Publication No. 10-257581 mentioned above.

In the headphone apparatus 2, the ear hangers 25 and 26 are hung on ear conches and the ends 25A and 26A are maintained to abut the back roots of the ear conches, respectively, so that the worn state is easily maintained, preventing the headphone from coming off the head during using the headphone.

In the headphone apparatus 2, an ear-muff style is adopted in that the driver units 21B and 22B are urged to ear conches from the outside, respectively, preventing ears from being heated unlike in ear-covering style headphones.

Furthermore, in the headphone apparatus 2, by adopting the above-mentioned ear-muff style, the diameter of the speaker unit is not limited to an earhole size unlike in inner-ear style headphones, so that sound quality can be improved by increasing the diameter as well as the deteriorated wearing feeling due to the unit insertion into the earhole can be solved.

The chin band style is practically difficult especially in the inner-ear style headphone because the load of the chin band is concentrated to the earhole. Whereas in the ear-hanger headphone apparatus according to the present invention, the load can be dispersed to the ear hangers 25 and 26, so that the problem of the headphone coming off due to weight increase with the radio communication unit 24 can be solved.

Furthermore, in the headphone apparatus 2, data is received from the transmitter 3 by means of radio communications, so that the burden of wiring is removed, providing comfortable listening circumstances to users.

By the configuration described above, the wireless headphone system 1 can further improve the wearing feeling of the headphone apparatus 2 as well as sound quality.

(3) Other Embodiments

According to the embodiment described above, the headphone apparatus 2 using the chin band 23 incorporates the headphone apparatus according to the present invention; the invention is not limited to this, and a so-called clip-style headphone apparatus having only left- and right-ear applied parts without a chin band may also be applied.

In this case, the clip-style headphone apparatus can reduce its weight by that of the chin band while solving the burden due to the chin band 23 positioned below a chin. Moreover, the clip-style headphone apparatus may be used as not only a binaural type but also a monaural type.

Figure 9:
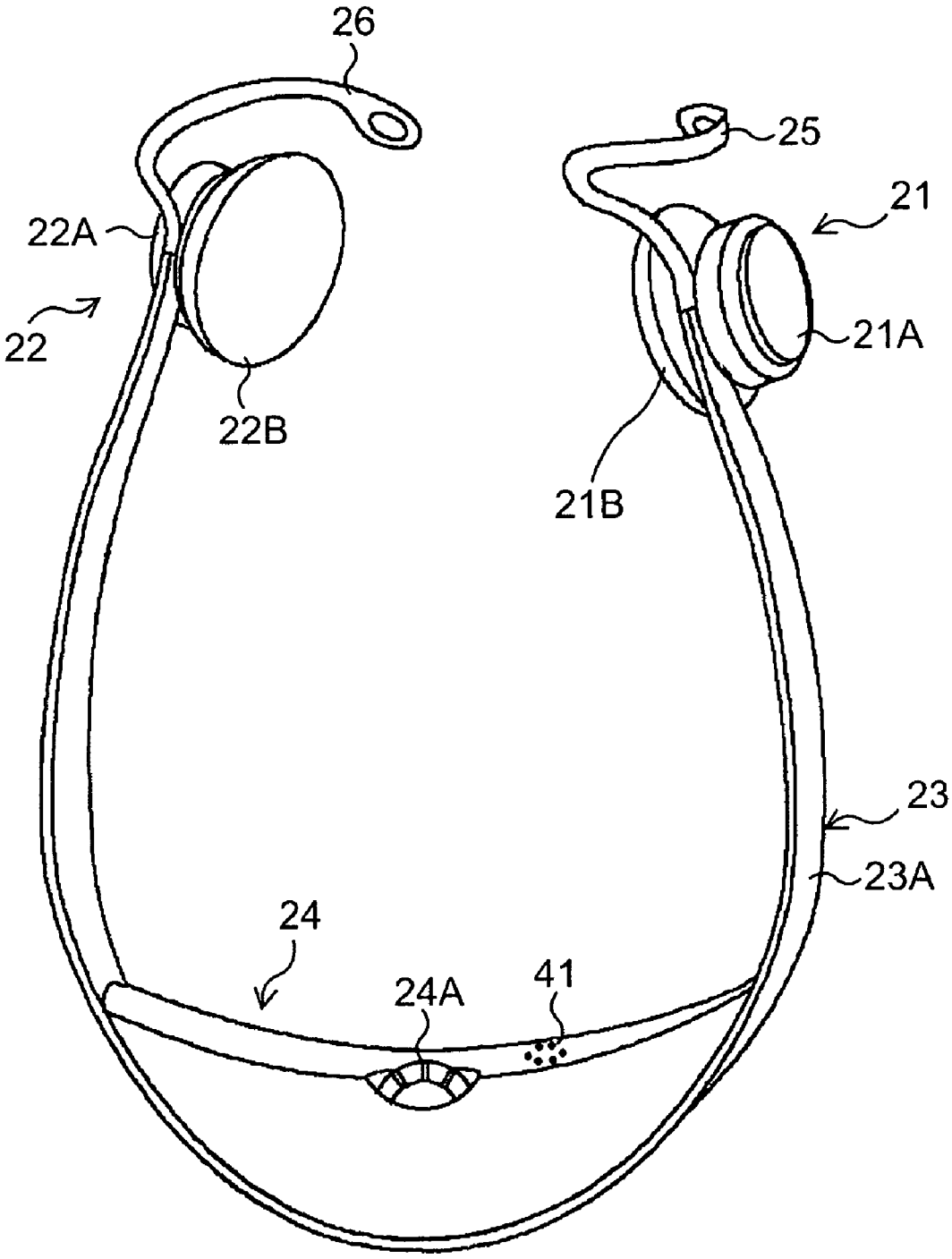
FIG. 9 is a front schematic perspective view of a headphone apparatus according to another embodiment.

According to the embodiment described above, the chin band 23 is provided with the radio communication unit 24 for power supply turning on/off and volume adjusting; the invention is not limited to this, so that a microphone 41 may be provided at a predetermined position of the radio communication unit 24, as shown in FIG. 9.

In this case, a sending circuit is provided in the headphone apparatus 2 and a receiving circuit is arranged in the transmitter 3, so that a voice collected via the microphone 41 may be transmitted to the transmitter 3 and other instruments (such as a stereo unit) by means of radio communications so as to exchange voices with the other instruments via the transmitter 3.

For example, a music sound of a CD player of the stereo unit is received from the headphone apparatus 2, and a user's sound transmitted from the microphone 41 is overlapped with the CD music sound so as to record it in the stereo unit.

Furthermore, according to the embodiment described above, the roughly L-shaped ear hangers 25 and 26 are used for ear hangers; the invention is not limited to this, so that ear hangers with various other shapes may also be used as long they can be hung on ears.

Furthermore, according to the embodiment described above, in the radio communication unit 24 arranged in the band part 23A of the chin band 23, the variable resistor adjusting rotary knob 24A, the power supply turning on/off button 24B, and the radio channel switch button 24C are provided; the invention is not limited to this, so that in the band part of the chin band 23, the variable resistor adjusting rotary knob 24A, the power supply turning on/off button 24B, and the radio channel switch button 24C may also be provided.

Furthermore, according to the embodiment described above, the ear-muff style driver units 21B and 22B are used; the invention is not limited to this, so that ear-covering driver units or inner-ear style driver units may also be used.

It should be understood by those skilled in the art that various modifications, combinations, sub-combinations and alterations may occur depending on design requirements and other factors insofar as they are within the scope of the appended claims or the equivalents thereof.

What is claimed is:

1. An ear-hanger headphone apparatus comprising:

a chin band having a U-shape and flexible band-part positioned below a chin when wearing the headphone apparatus;

a housing attached to an end of the band part;

a driver unit attached to the housing via a screw that is screwed into the housing in an oblique direction with the driver unit between the screw and the housing to attach the driver unit to the housing swingably in universal directions relative to the housing so as to closely overlap with an ear conch without clearance when the driver unit is pushed to the ear conch by the flexibility of the band part; and an ear hangar provided to the end of the band part the ear hanger being L-shaped and curved inward so that its end abuts a back root of the ear conch when the headphone apparatus is worn.

2. The apparatus according to claim 1, wherein the end portion of the ear hanger is made of an elastic elastomer resin.

3. The apparatus according to claim 1, wherein the chin band is provided with various operation buttons arranged on part of the band part.

4. The apparatus according to claim 1, further comprising a unit attached to a lower portion of the U-shaped band-part for accommodating operation buttons for operating the headphone apparatus and a battery therein.

5. An ear-hanger headphone apparatus comprising:

an ear hangar having a predetermined shape;

a housing integrally attached to the ear hangar; and a driver unit attached to the housing via a screw that is screwed into the housing in an oblique direction with the driver unit between the screw and the housing to attach the driver unit to the housing swingably in universal directions relative to the housing so as to closely overlap with an ear conch without clearance, when the headphone apparatus is worn.

6. A headphone system comprising:

an ear-hanger headphone apparatus including a chin band having a U-shape and flexible band part positioned below a chin when wearing the headphone apparatus;

a housing attached to an end of the band part;

a driver unit attached to the housing housings via a screw that is screwed into the housing in an oblique direction with the driver unit between the screw and the housing to attach the driver unit to the housing swingably in universal directions relative to the housing so as to closely overlap with an ear conch without clearance when the driver unit is pushed to the ear conch by the flexibility of the band part; and an ear hangar provided to the end of the band part, the ear hanger being L-shaped and curved inward so that its end abuts a back root of the ear conch when the headphone apparatus is worn; and a relay transmitter for transmitting data by means of radio communications with the ear-hanger headphone apparatus.

7. The system according to claim 6, wherein the relay transmitter includes a rack for placing the chin band of the ear-hanger headphone apparatus thereon, and the headphone apparatus is electrically charged via the rack.

8. The apparatus according to claim 1, wherein the driver unit includes a diaphragm that is connected to the screw with a clearance between the diaphragm and the screw so that the driver unit can swing about the screw in the universal directions within a movable range corresponding to the clearance.

9. The apparatus according to claim 5, wherein the driver unit includes a diaphragm that is connected to the screw with a clearance between the diaphragm and the screw so that the driver unit can swing about the screw in the universal directions within a movable range corresponding to the clearance.

10. The system according to claim 6, wherein the driver unit includes a diaphragm that is connected to the screw with a clearance between the diaphragm and the screw so that the driver unit can swing about the screw in the universal directions within a movable range corresponding to the clearance.

* * * * *